US009336661B2

(12) United States Patent
Kang et al.

(10) Patent No.: US 9,336,661 B2
(45) Date of Patent: May 10, 2016

(54) SAFETY COMMUNICATION SYSTEM AND METHOD THEREOF

(71) Applicant: Electronics and Telecommunications Research Institute, Daejeon (KR)

(72) Inventors: Hyun Chul Kang, Daejeon (KR); Tae Gyu Kang, Daejeon (KR); In Su Kim, Daejeon (KR); Jong Woo Choi, Daejeon (KR); Jin Doo Jeong, Daejeon (KR); Jung Sik Sung, Daejeon (KR); Seong Hee Park, Daejeon (KR); Hyun Joo Kang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 90 days.

(21) Appl. No.: 14/260,676

(22) Filed: Apr. 24, 2014

(65) Prior Publication Data

US 2015/0137986 A1 May 21, 2015

(30) Foreign Application Priority Data

Nov. 18, 2013 (KR) ..... 10-2013-0139716

(51) Int. Cl.

| | |
|---|---|
| ***G08B 3/00*** | (2006.01) |
| ***G08B 5/36*** | (2006.01) |
| ***G08B 25/08*** | (2006.01) |

(52) U.S. Cl.

CPC . *G08B 5/36* (2013.01); *G08B 25/08* (2013.01)

(58) Field of Classification Search

None

See application file for complete search history.

(56) References Cited

U.S. PATENT DOCUMENTS

| | | | | |
|---|---|---|---|---|
| 4,801,928 A * | 1/1989 | Minter | G08B 7/066 | 340/309.4 |
| 6,259,365 B1 * | 7/2001 | Hagar | G08B 21/086 | 340/541 |
| 8,659,416 B1 * | 2/2014 | Higgins | G08B 5/38 | 340/514 |
| 2004/0036603 A1 * | 2/2004 | Bingham | G08B 13/19695 | 340/541 |

FOREIGN PATENT DOCUMENTS

| | | |
|---|---|---|
| KR | 10-2013-0068451 A | 6/2013 |
| KR | 10-2013-0086863 A | 8/2013 |

OTHER PUBLICATIONS

"Security Communication Technologies in Living Space", Symposium—Ministry of Science, ICT and Future Planning, Oct. 15, 2013.

* cited by examiner

*Primary Examiner* — Travis Hunnings

(57) ABSTRACT

Disclosed are a safety communication system and a method thereof that provide a risk occurrence position and a notification function, and more particularly, disclosed is communication technology including a sensor based lighting for rapidly responding to a risk situation. The safety communication system according to an exemplary embodiment of the present invention includes: a device sensing a risk situation; a lighting crime prevention system analyzing risk situation data received from the device and including a position ID to generate situation data; and a lighting control system controlling an operation of a lighting depending on the situation data.

15 Claims, 9 Drawing Sheets

SAFETY COMMUNICATION SYSTEM AND METHOD THEREOF

CROSS-REFERENCE TO RELATED APPLICATIONS

This application claims priority to and the benefit of Korean Patent Application No. 10-2013-0139716 filed in the Korean Intellectual Property Office on Nov. 18, 2013, the entire contents of which are incorporated herein by reference.

TECHNICAL FIELD

The present invention relates to a safety communication system and a method thereof that provide a risk occurrence position and a notification function, and more particularly, to communication technology including a sensor based lighting for rapidly responding to a risk situation.

BACKGROUND ART

In recent years, with the development of communication technology, a research to apply the communication technology to various fields has been performed. The communication technology is applied to even a crime prevention field or a security field for preventing crimes, and for example, the communication technology is applied to the security field by a method of monitoring whether crime occurs in a corresponding zone based on a video collected through a CCTV installed in a security zone.

As a detailed example, the CCTV is installed in a park or a street, and as a result, the video is monitored in real time through the CCTV by considering a time when the crime frequently occurs, such as evening when situation distinguishment is difficult or the video collected by the CCTV is stored, and a vide stored after the crime occurs is retrieved to be used to arrest a criminal.

In order to provide a more intelligent service, attempts are being made to prevent an accident by analyzing contents including the video collected by using the CCTV in real time to capture an abnormal symptom.

However, a significant complicated algorithm is required to implement abnormal situation analysis modeling by analyzing the contents and it is actually difficult to apply the algorithm to the abnormal situation analysis modeling.

SUMMARY OF THE INVENTION

The present invention has been made in an effort to provide a safety communication system and a method thereof that can rapidly respond to a risk situation by detecting the risk situation by using a device including a sensor and a CCTV, responding to the risk situation by using data associated with the risk situation and a lighting, and determining a position where the risk situation occurs.

An exemplary embodiment of the present invention provides a safety communication system including: a device sensing a risk situation; a lighting crime prevention system analyzing risk situation data received from the device and including a position ID to generate situation data; and a lighting control system controlling an operation of a lighting depending on the situation data.

The safety communication system may further include a lighting position system managing position ID information of the device.

The lighting crime prevention system may include a risk situation detecting unit extracting the risk situation data received from the device and the position ID of the lighting, tracking a route, and notifying the risk situation data and route tracking information to the outside and the inside; a device managing unit updating the information on the device; and a risk situation data analyzing unit analyzing and storing data based on information collected from the device, generating a situation data schema, and tracking route data.

The risk situation detecting unit may include a VLC transmitting/receiving unit for transmitting/receiving VLC data; a risk situation communication unit transmitting/receiving data so as to communicate with the device; a risk situation detecting unit collecting and detecting information on the risk situation; and a risk situation monitoring unit periodically monitoring the situation data.

The device detecting unit may include a device information receiving unit receiving information from the device; a device information extracting unit outputting the received data of the device; a device interface unit inputting, by a user, the information on the device; a device monitoring unit configuring the device or monitoring the collected information; a device network managing unit managing a device network by registering, changing, or deleting the device; and a device mapping unit mapping the information on the device and positional information of the lighting.

The risk situation data analyzing unit may include a situation data interanalyzing unit analyzing the situation data, and collecting and analyzing device network information; a route tracking unit tracking a movement route based on the device network information; a situation data schema processing unit classifying the analyzed situation data into a situation data schema; a situation data generating unit generating the situation data; a situation data storing unit storing the situation data; and an external/internal data transmitting unit transmitting the situation data to the lighting control system.

The lighting control system may include a lighting control unit constructing a safety lighting network.

The lighting control unit may include a lighting situation data processing unit extracting lighting situation data by receiving the situation data; a lighting control data processing unit controlling the lighting based on the lighting situation data; a lighting data transmitting unit transmitting data for controlling the lighting; a safety lighting group managing unit performing group management of the lighting for each area through the safety lighting network; a safety lighting network managing unit designing and managing the safety lighting network; and a safety lighting interface unit interconverting data configuring the safety lighting network.

The lighting position system may include a lighting position unit mapping the safety lighting network of the lighting control system and the lighting position.

The lighting position unit may include a lighting position managing unit managing the positional information of the lighting; a lighting position data mapping unit mapping the positional information of the lighting to the device and converting the positional information; and a lighting position data transmitting unit transmitting the positional information of the lighting to the device or the lighting control system.

The device may use a smart phone, a camera, a sensor, and a lighting.

Another exemplary embodiment of the present invention provides a safety communication method including: sensing, by a device, a risk situation and generating risk situation data; transmitting, by the device, the risk situation data including a position ID to a lighting crime prevention system; analyzing, by the lighting crime prevention system, the risk situation data and generating situation data; transmitting the situation data to a lighting control system; and controlling, by the lighting control system, an operation of a lighting depending on the situation data.

The transmitting, by the device, of the risk situation data to the lighting crime prevention system may include sensing, by the device, the risk situation; transmitting position ID data of the device to a position ID receiver; converting the position ID data into VLC position ID data; transmitting, by the position ID receiver, the VLC position ID data to a mobile phone; and transmitting the risk situation data by using the mobile phone.

The risk situation data may include a VLC position, a mobile ID, and a user name.

The position ID receivers may be paired by using the mobile phone and the Bluetooth.

In the transmitting of the risk situation data to the lighting crime prevention system, a sensor based lighting using a communication interface using the mobile phone may be included.

The communication interface may include a sensor based lighting including WLANRS485, WLAN, HSDPA, 4G, LTE, WIFI, RFID, Zigbee, DALI, DMX, and VLC.

The lighting position system may manage an ID of data.

The device may include devices capable of collecting information, including a CCTV, a speaker, a camera, a terminal, an LED lighting, and a VLC transmitter/receiver.

According to exemplary embodiments of the present invention, a safety lighting network can be constructed by recognizing and responding to a risk situation by using various devices including a sensor and a lighting.

The technology can control the position, a color or brightness of a lighting at a position where the risk situation occurs to rapidly notify surrounding risk situations to a plurality of persons and delay an urgent risk situation.

The technology can strengthen a monitoring function through the construction of the safety lighting network and rapidly respond to crimes by accurately determining the position where the risk situation occurs.

DETAILED DESCRIPTION

Hereinafter, for detailed description so as for those skilled in the art to easily implement the technical spirit of the present invention, the accompanying drawings illustrating exemplary embodiments of the present invention will be referred to.

Figure 1:
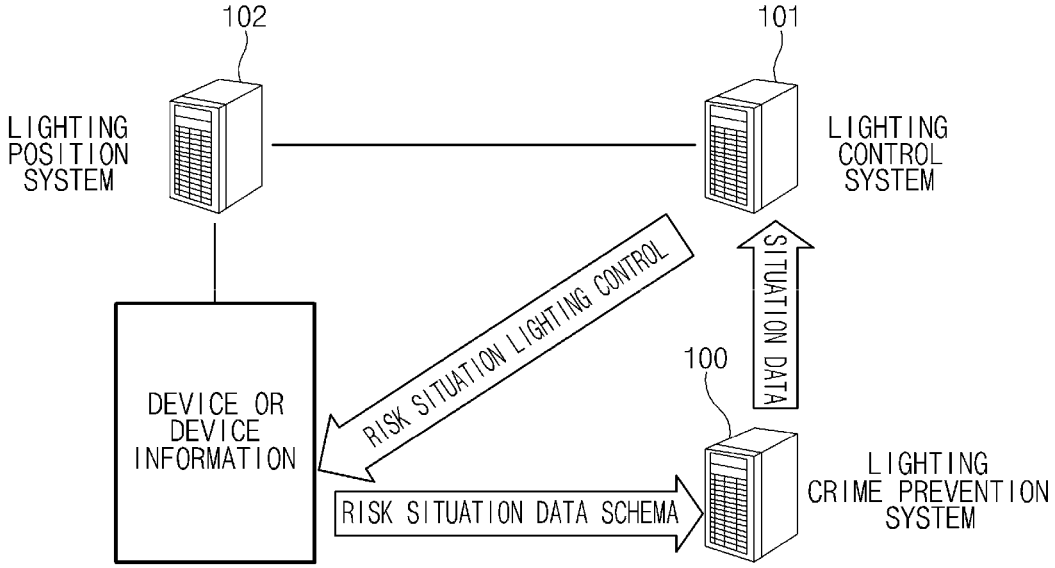
FIG. 1 is a configuration diagram of a safety communication system according to an exemplary embodiment of the present invention.

FIG. 1 is a configuration diagram of a safety communication system (LSCS) according to an exemplary embodiment of the present invention.

FIG. 1 illustrates a system for detecting a risk situation by using a device including a sensor and a CCTV, controlling a lighting, and determining the position of the lighting when the risk situation occurs. In detail, the device that detects the risk situation may include all devices that may collect information which may be generated in time and space, such as a sensor, a CCTV, a speaker, a camera, a terminal, an LED lighting, a VLC transmitter/receiver, and the like.

Referring to FIG. 1, a safety communication system according to the exemplary embodiment of the present invention includes a lighting crime prevention system 100, a lighting control system 101, and a lighting position system 102.

The lighting crime prevention system 100, the lighting control system 101, and the lighting position system 102 provided to prevent crimes such as sexual violence, school violence, or family violence may be separated into respective systems to be implemented or integrated into one system to be implemented. The systems may be variously changed in accordance with a direction to design the safety communication system and in the specification, the systems will be described based on structures of separated systems.

The lighting crime prevention system 100 serves to perform a function to determine or monitor the risk situation, interanalyze risk situation element data in real time, extract and store situation lighting data, and transfer situation data to the lighting control system 101 through risk situation data schema processing.

The lighting control system 101 is a system that may control a lighting depending on the risk situation, and construct or manage a lighting network by transmitting and processing lighting data.

The lighting position system 102 is a system that manages an ID of a lighting in a risk occurrence area in order to accurately determine a position where a risk occurs.

Figure 2:
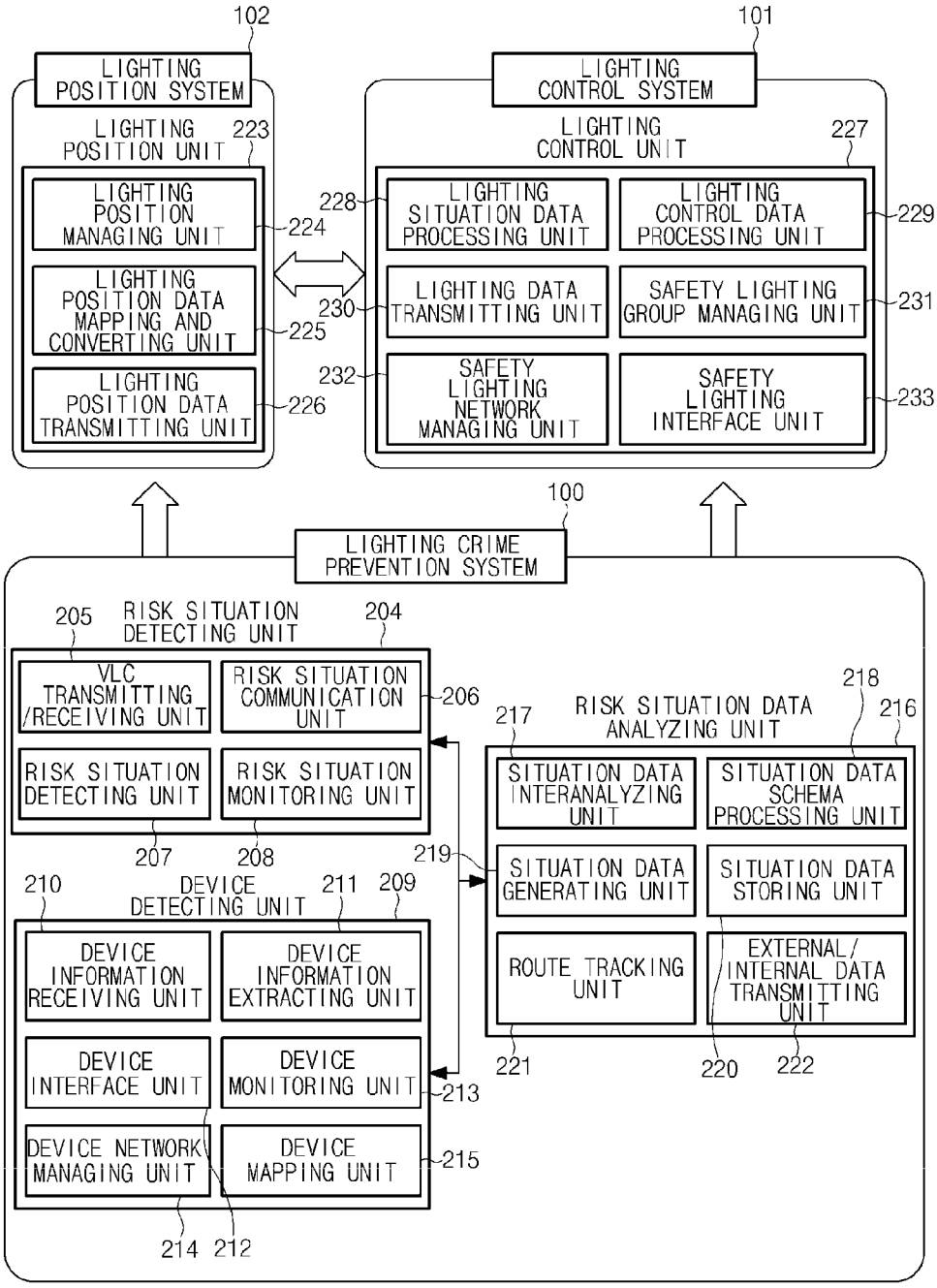
FIG. 2 is a module configuration diagram of the safety communication system according to the exemplary embodiment of the present invention.

FIG. 2 is a module configuration diagram of the safety communication system according to the exemplary embodiment of the present invention.

Referring to FIG. 2, detailed configurations of the lighting crime prevention system 100, the lighting control system 101, and the lighting position system 102 of the safety communication system will be described in detail.

The lighting crime prevention system 100 includes a risk situation detecting unit 204, a device detecting unit 209, and a risk situation data analyzing unit 216.

The risk situation detecting unit 204 includes a visible light communication (VLC) transmitting/receiving unit 205, a risk situation communication unit 206, a risk situation detecting unit 207, and a risk situation monitoring unit 208.

The VLC transmitting/receiving unit 205 serves to transmit/receive VLC data.

The risk situation communication unit 206 transmits/receives data so as to communicate the risk situation with an external apparatus when the risk situation occurs.

The risk situation detecting unit 207 collects risk related information in order to detect the risk situation and detects accurate information about risk occurrence.

The risk situation monitoring unit 208 periodically monitors situation data.

The device detecting unit 209 includes a device information receiving unit 210, a device information extracting unit 211, a device interface unit 212, a device monitoring unit 213, a device network managing unit 214, and a device mapping unit 215.

The device information receiving unit 210 receives information from various devices.

The device information extracting unit 211 receives related information from a corresponding device installed in a risk occurrence place or space or a neighboring device and extracts data.

The device interface unit 212 performs an interfacing operation so that a user inputs and sets device information from an external input. The user may manage all device management information through the device interface unit 212. The device management information includes all of device information and device network management information, mapping information, and the like.

The device monitoring unit 213 configures various devices or monitors collected information.

The device network managing unit 214 manages a network of devices which are usable for crime prevention by registering devices in the lighting crime prevention system 100 or changing or deleting the devices.

The device mapping unit 215 serves to map information on the devices registered through device network management and positional information of the lighting. Types of the devices may include all devices and apparatusesthat may collect information which may be generated in time and space, such as the sensor, the CCTV, the speaker, the camera, the terminal, the LED lighting, the VLC transmitter/receiver, and the like.

The risk situation data analyzing unit 216 includes a situation data interanalyzing unit 217, a situation data schema processing unit 218, a situation data generating unit 219, a situation data storing unit 220, a route tracking unit 221, and an external/internal data transmitting unit 222.

The situation data interanalyzing unit 217, the situation data generating unit 219, and the situation data storing unit 220 serve to interanalyze the situation data based on information collected from the device and store the situation data, and generate information on a situation. When the risk situation occurs, data is analyzed and accumulated to store a schema of the situation data and designate an optimal situation data schema.

The route tracking unit 221 may track route data regarding time or space where a specific situation occurs or all movement routes which are generated before or after the time through the situation data. The situation may be classified into various forms including an emergency situation, a safety situation, an alarm situation, and the like according to a definition by the user.

The external/internal data transmitting unit 222 may transmit information on the situation to the outside or the inside as data.

Next, the lighting control system 101 includes a lighting control unit 227.

Herein, the lighting control unit 227 includes a lighting situation data processing unit 228, a lighting control data processing unit 229, a lighting data transmitting unit 230, a safety lighting group managing unit 231, a safety lighting network managing unit 232, and a safety lighting interface unit 233.

The lighting situation data processing unit 228 receives the situation data from the risk situation data analyzing unit 216 to extract lighting situation data.

The lighting control data processing unit 229 controls the lighting based on the lighting situation data.

The lighting data transmitting unit 230 may combine and transmit data for controlling the lighting, and additional information on the situation and control information of a receiving terminal of the user or a neighboring device.

The safety lighting group managing unit 231 may perform group management of the lighting for each area through a network of a safety lighting. The safety lighting group managing unit 231 may perform safety lighting management for crime prevention through detailed group management.

The safety lighting network managing unit 232 serves to design and manage a safety lighting area for crime prevention. The safety lighting network may be generated, modified, or deleted through the safety lighting network managing unit 232 in order to construct the safety lighting area. Further, profile management for constructing the safety lighting network may be performed.

The safety lighting interface unit 233 serves as a passage capable of setting all data so as for the user to construct the safety lighting network from the external input. The user may manage safety lighting network management information through the safety lighting interface unit 233.

Next, the lighting position system 102 includes a lighting position unit 223.

The lighting position unit 223 includes a lighting position managing unit 224, a lighting position data mapping and converting unit 225, and a lighting position data transmitting unit 226.

The lighting position managing unit 224 manages the positional information of the lighting.

The lighting position data mapping and converting unit 225 serves to map the positional information of the lighting to a corresponding device and convert the positional information.

The lighting position data transmitting unit 226 transmits the positional information of the lighting to the lighting control system or a related device.

Figure 3:
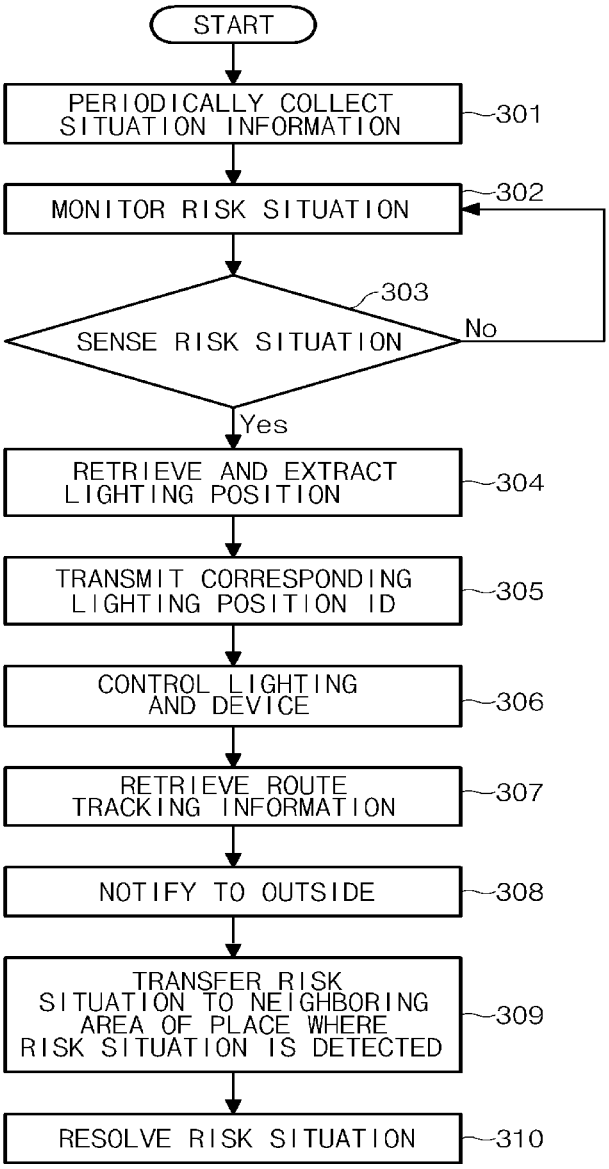
FIG. 3 is a flowchart describing a risk situation detecting unit of a lighting crime prevention system according to an exemplary embodiment of the present invention.

FIG. 3 is a flowchart describing an operation of a risk situation detecting unit (204 of FIG. 2) of a lighting crime prevention system according to an exemplary embodiment of the present invention.

Referring to FIG. 3, the risk situation detecting unit (207 of FIG. 2) periodically collects the situation information from the device information (301).

The risk situation monitoring unit (208 of FIG. 2) periodically monitors the risk situation, which includes information collected from various devices (a user alarm button input, Bluetooth, a sensor, a CCTV, a camera, a smart phone, a VLC transmitter/receiver, and the like) (302).

The risk situation detecting unit (207 of FIG. 2) verifies whether the risk situation is sensed (303). For example, the user may input an alarm or risk button by using the smart phone or when the risk situation is sensed by a sensor capable of sensing occurrence of the risk, the risk situation may be sensed.

When a risk situation monitoring unit (208 of FIG. 2) senses the risk situation, the lighting position unit (223 of FIG. 2) retrieves the positional information of the lighting of the space where the risk situation is sensed and extracts risk target data (304).

Next, the risk situation communication unit (206 of FIG. 2) may transmit a position ID of a corresponding sensing lighting through all available wired/wireless communication interfaces (RS485, WLAN, HSDPA, 4G, LTE, WIFI, RFID, Zigbee, DALI, DMX, the VLC transmitter/receiver, and the like) before and after retrieving the positional information of the lighting (305).

Subsequently, the lighting control system (101 of FIG. 2) receives the lighting position ID and thereafter, controls a corresponding lighting and a corresponding device (306). For example, the risk situation may be notified by using the corresponding lighting device or a speaker of a neighboring device or the risk situation may be notified also by using a siren, flickering of the lighting, brightness control of the lighting, or a lighting color.

Next, the situation data interanalyzing unit (217 of FIG. 2) retrieves route tracking information for time before or after an accident occurs (307).

Next, the risk situation communication unit (206 of FIG. 2) may notify all neighboring device information to a control center, a police station, a 119 rescue party, or a security center and transmit all collected data information (308). In this case, when the risk situation is sensed, there are provided all route tracking information and neighboring device information which are available within a radius set from a place where the risk situation is sensed.

The risk situation communication unit (206 of FIG. 2) notifies an emergency situation by using a neighboring device (neighboring lighting control or speaker broadcasting) to a position most adjacent to a position where the risk situation is detected to rapidly respond to or solve the risk situation (309 and 310).

Figure 4:
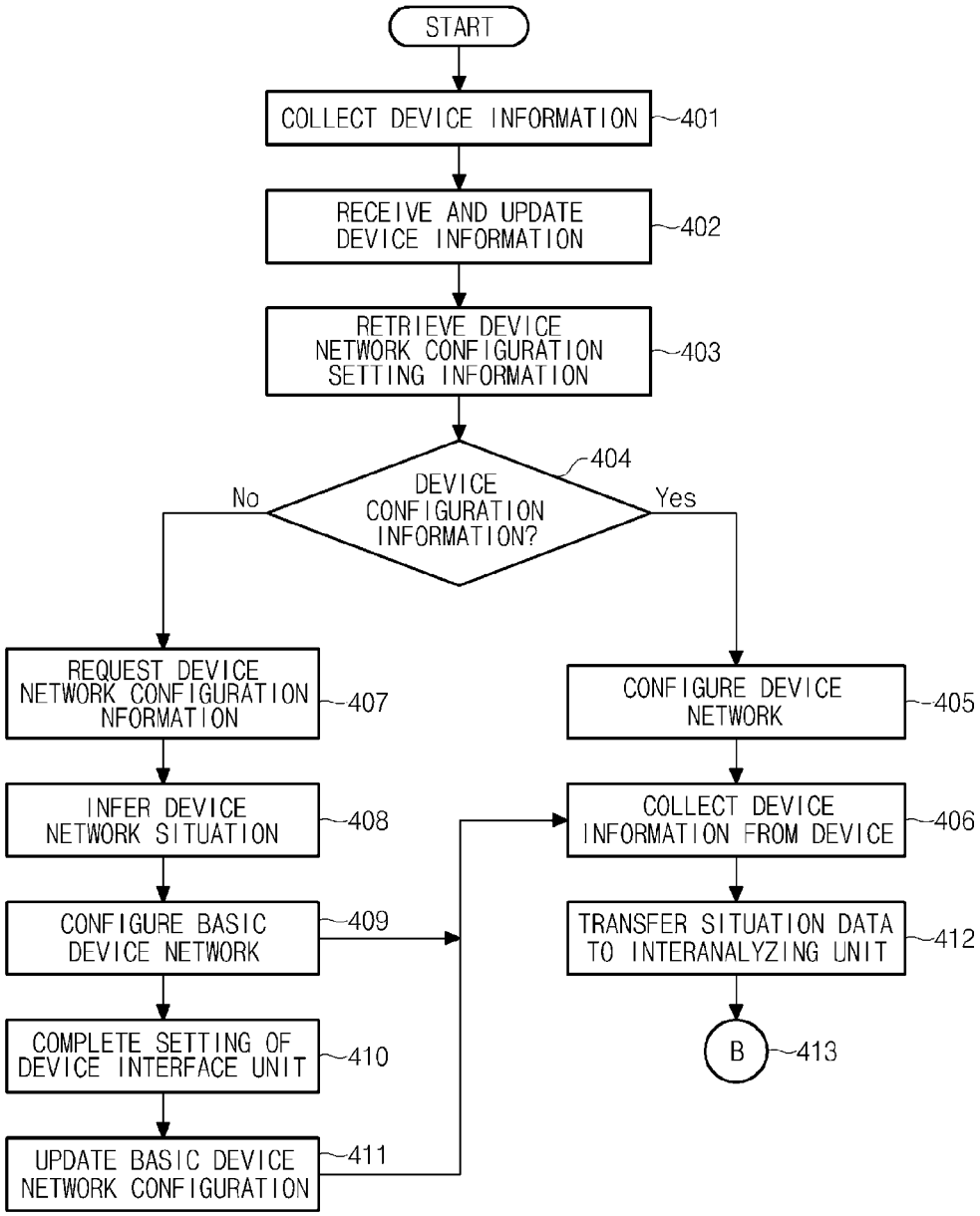
FIG. 4 is a flowchart describing a device detecting unit of the lighting crime prevention system according to the exemplary embodiment of the present invention.

FIG. 4 describes details of a device detecting unit (209 of FIG. 2) of the lighting crime prevention system according to the exemplary embodiment of the present invention.

Referring to FIG. 4, the device information receiving unit (210 of FIG. 2) collects data from all device information (401).

Next, the device information extracting unit (211 of FIG. 2) receives the collected device information to store the received device information in a database or update the received device information (402). Herein, the device information may be collected by using the CCTV, the camera, the sensor, the speaker, the terminal, and the like. Device information may be collected by using all sensing devices which are combined with or separated from a lighting provided around.

Subsequently, the device interface unit (212 of FIG. 2) retrieves device network configuration setting information (403).

Subsequently, the device interface unit (212 of FIG. 2) determines whether device configuration information is present (404).

When the device configuration information is present (Y), the device network is configured based on the retrieved device configuration information (405). The user may edit or set the device network configuration information in advance through the device interface unit (212 of FIG. 2) in order to configure the device network or infer a basic device network situation by inferring basic device network configuration information of the system in the situation data interanalyzing unit (217 of FIG. 2).

Subsequently, the device network managing unit (214 of FIG. 2) collects the device information from the corresponding device (406).

However, when the device configuration information is not present (N), the device interface unit (212 of FIG. 2) transmits a device network configuration information request message to the device monitoring unit (213 of FIG. 2) so as for the user to recognize the device network configuration information request message (407).

Next, the situation data interanalyzing unit (217 of FIG. 2) infers the device network situation information (408) to configure the basic device network (409) until a response message is received from the user.

Subsequently, after basic device information is configured, the device network managing unit (214 of FIG. 2) first collects the device information from the device in advance (406).

When the user completes configuration information setting in response to a configuration information request from the device interface unit (212 of FIG. 2) (410), the user receives a setting completion message from the device interface unit (212 of FIG. 2).

Next, after receiving the setting completion message from the device interface unit (212 of FIG. 2), the user updates the basic device network configuration information inferred with the situation to the basic device network configuration information which the user finally verifies and collects the device information (411).

Subsequently, after the information is collected from the device, the device network managing unit (214 of FIG. 2) transmits related data to the situation data interanalyzing unit (217 of FIG. 2) (412) and branches the transmitted related data to B (413).

Figure 5:
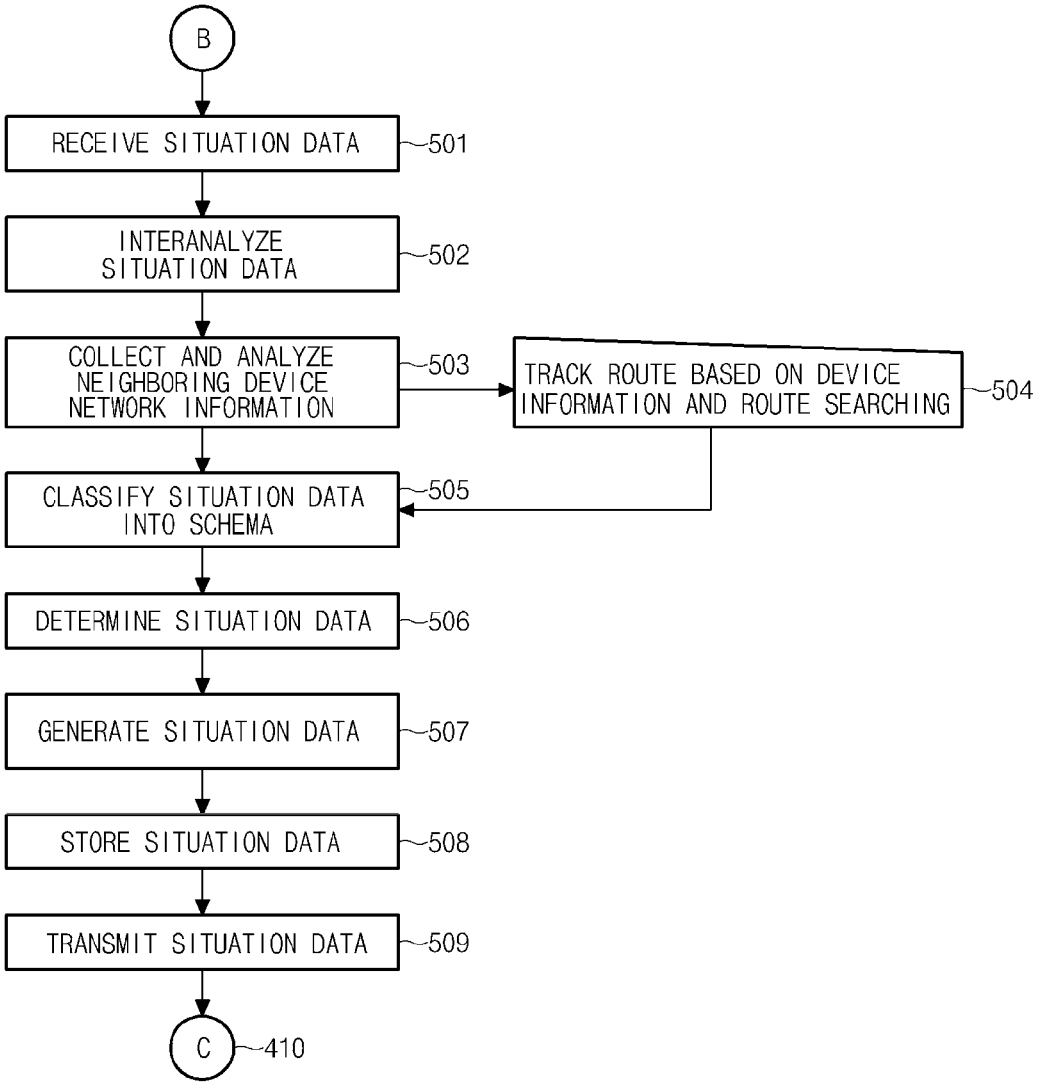
FIG. 5 is a flowchart describing a risk situation data analyzing unit of the lighting crime prevention system according to the exemplary embodiment of the present invention.

FIG. 5 is a flowchart for describing an operation of a risk situation data analyzing unit (216 of FIG. 2) of the lighting crime prevention system according to the exemplary embodiment of the present invention.

Referring to FIG. 5, the situation data interanalyzing unit (217 of FIG. 2) receives the situation data (501).

Next, the situation data interanalyzing unit (217 of FIG. 2) performs an operation of integrating and analyzing the situation data (502).

The situation data interanalyzing unit (217 of FIG. 2) collects and analyzes all device information within a set radius range as well as collecting and analyzing neighboring device network information (503).

Subsequently, the route tracking unit (221 of FIG. 2) tracks a moved route and an anticipated movement route based on the data collected from the device information (504). For example, a risk situation element may be extracted by analyzing video information collected through the CCTV. Further, a current situation may be determined by analyzing lighting and CCTV information and sensor information in a device installed along the movement route.

Next, the situation data schema processing unit (218 of FIG. 2) may classify the analyzed situation data information to the situation data schema (505). The user may define the situation data schema in various forms.

The user may define a user's caution alarm level schema in the situation data schema. The caution alarm level schema may be divided into 'a safety level', 'a caution level', 'a risk level', and the like. In the 'safety level', it may be determined that a current situation is a safe situation, in the 'caution level', it may be determined that in a current situation, the risk situation may occur and a caution is required, and in the 'risk level', it may be determined that a current situation is a situation where the risk situation occurs. That is, the situation data may be determined (506).

Subsequently, the situation data generating unit (219 of FIG. 2) generates the situation data schema to be classified to a user data schema by analyzing the situation data (507).

Next, the situation data storing unit (220 of FIG. 2) stores the generated situation data (508).

Subsequently, the external/internal data transmitting unit (222 of FIG. 2) transmits the generated situation data to a lighting control server (509) and branches the transmitted situation data to C (510). The situation data includes real-time media, and the like, and as a result, all data and analysis information collected through the device may be together transmitted to the outside (the police station, a public office, the security center, and the like) and the inside (the control center, the lighting control system, and the like).

Figure 6:
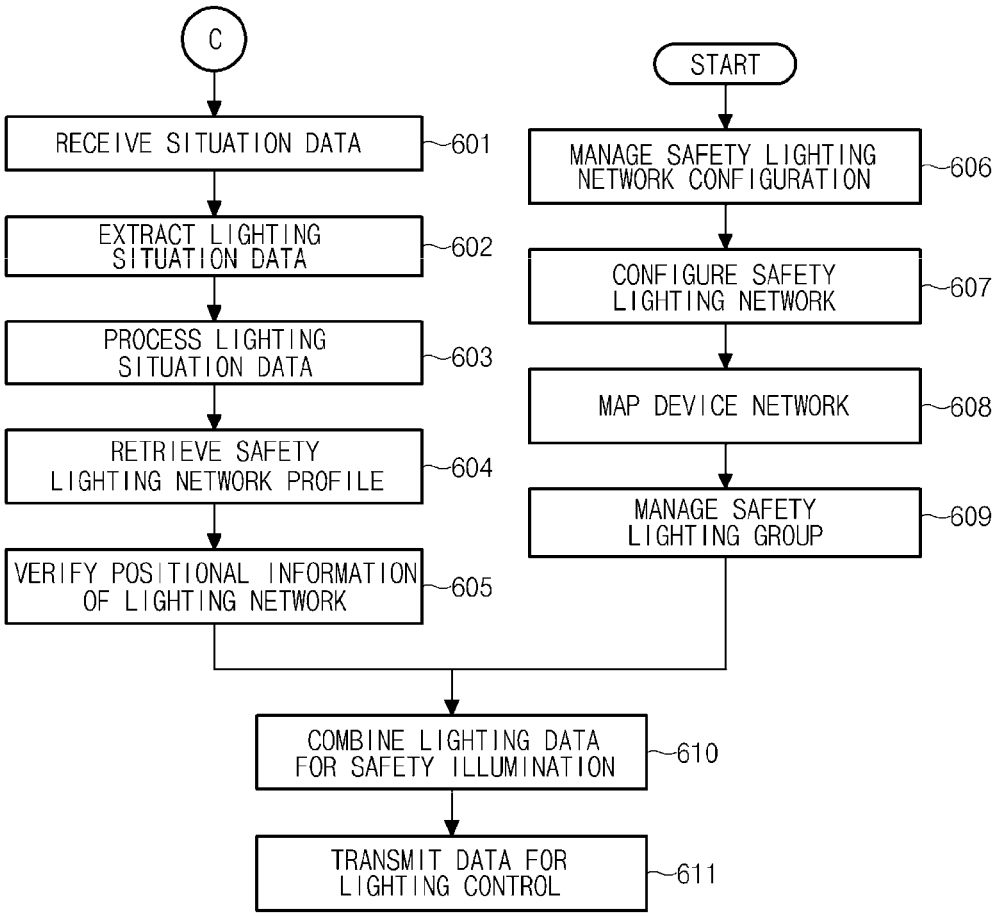
FIG. 6 is a flowchart describing a lighting control unit of a lighting control system according to an exemplary embodiment of the present invention.

FIG. 6 is a flowchart for describing an operation of a lighting control unit (227 of FIG. 2) of a lighting control system according to an exemplary embodiment of the present invention.

Referring to FIG. 6, the lighting control system (202 of FIG. 2) receives the situation data from the lighting crime prevention system (201 of FIG. 2) (601).

The lighting situation data processing unit (228 of FIG. 2) extracts the lighting situation data from the received situation data (602). Parameters associated with the lighting among the extracted lighting situation data include a color of the lighting, ON or OFF of the lighting, dimming of the lighting or not, a dimming level of the lighting, and the like. The parameters may be added, generated, or deleted by the user definition.

The lighting situation data processing unit (228 of FIG. 2) converts the lighting situation data into data suitable for the lighting control and processes the converted data (603).

Next, the safety lighting network managing unit (232 of FIG. 2) retrieves a safety lighting network profile to control the lighting (604). Herein, the safety lighting network profile may be, in advance, set by the user.

Next, the safety lighting network managing unit (232 of FIG. 2) verifies the positional information of the lighting based on the safety lighting network profile (605). In this case, the lighting position unit (223 of FIG. 2) receives the positional information of the lighting. Herein, in the safety lighting network profile, parameter values for constructing a safety lighting environment may be variously set, which include 'positional information of a lighting', 'a space address', 'a device ID', 'a device type', 'a group ID', 'a group name', 'a lighting ID', 'a network address', 'a lighting kind', 'a lighting type', 'a profile ID', 'a profile code', 'a lighting control type', and the like. Moreover, additional parameters associated with the lighting may be added, modified, or deleted by the user.

The safety lighting interface unit (233 of FIG. 2) may manage a network profile of a safety lighting by an external input (the user input, and the like) or an internal input (the situation inferring, and the like) (606).

In the safety lighting network managing unit (232 of FIG. 2), the network profile of the safety lighting interworks with preset device network configuration information to configure the safety lighting network (607). Herein, a purpose of configuring the safety lighting network is to construct a safe lighting network by configuring safety lighting topology, which includes the lighting and device information.

The safety lighting network managing unit (232 of FIG. 2) performs a procedure of mapping preset device network information with the safety lighting network information (608).

The safety lighting group managing unit (231 of FIG. 2) subdivides a safety lighting group by using a safety lighting group ID to perform group management (609).

The lighting situation data processing unit (228 of FIG. 2) combines sensing lighting information for the safety lighting and the situation information (610).

The lighting data transmitting unit (230 of FIG. 2) transmits the combined sensing lighting data to control an optimized lighting (611).

Figure 7:
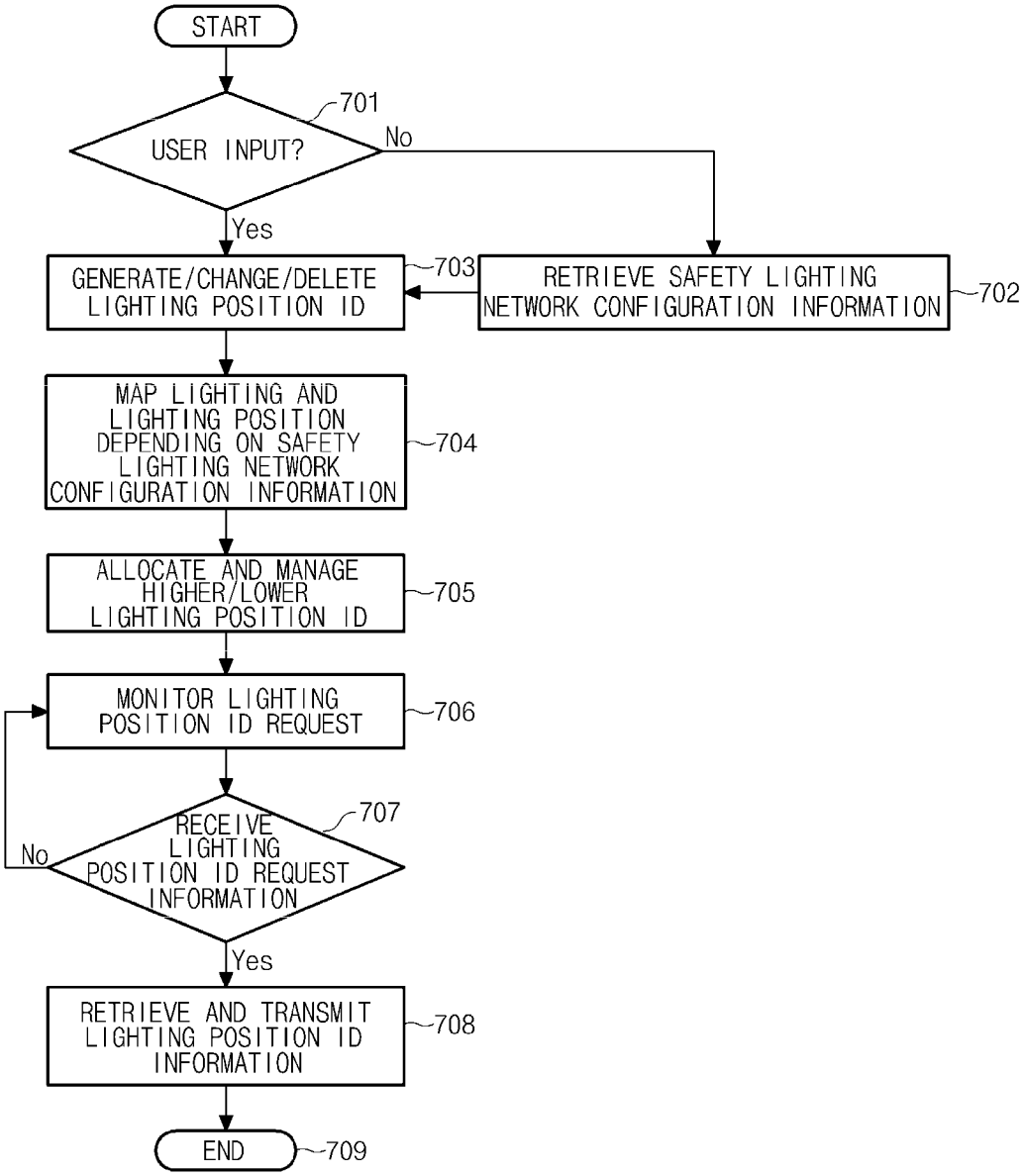
FIG. 7 is a flowchart describing a lighting position unit of a lighting position system according to an exemplary embodiment of the present invention.

FIG. 7 is a flowchart for describing an operation of a lighting position unit (223 of FIG. 2) of a lighting position system according to an exemplary embodiment of the present invention.

Referring to FIG. 7, the lighting position managing unit (224 of FIG. 2) manages the lighting position ID according to the position where the lighting is installed. The lighting position ID may be set by the user (701) and the safety lighting network configuration information corresponding to the outside is retrieved to be randomly or sequentially automatically allocated (702). Therefore, a lighting position ID corresponding to a physical or logical position ID is managed. The lighting position ID may be classified into a higher lighting position ID and a lower lighting position ID. The higher lighting position ID may notify a specific area by grouping the lower lighting position IDs and the lower lighting position ID represents position IDs of individual lightings.

Next, the lighting position ID may be generated, changed, or deleted (703).

Subsequently, the lighting data mapping and converting unit (225 of FIG. 2) maps and converts the lighting and the positional information of the lighting depending on the safety lighting network configuration information (704).

Next, the lighting position managing unit (224 of FIG. 2) may grant and manage a higher lighting position ID and a lower lighting position ID of a corresponding area according to a lighting registered in the safety lighting network configuration information (705). Herein, the lighting position ID information enables inquire into or retrieve all information associated with the lighting, which includes a lighting position, a lighting ID, a place where the lighting is installed, an installation manager, a phone number, a life-span, and the like and the lighting position ID information is distinguished as distinghishable key ID information to be used. All information of the lighting control system, the lighting crime prevention system, and the lighting position system interworks with a key ID to bring corresponding information.

The lighting position managing unit (224 of FIG. 2) periodically monitors whether there is a lighting position ID request (706).

When the lighting position managing unit (224 of FIG. 2) receives lighting position ID request information from internal and external systems (707), the lighting data transmitting unit (226 of FIG. 2) transmits data by retrieving the lighting position ID and thereafter, the process is ended (708 and 709).

However, when the lighting position ID request information is not received, the process is branched to lighting position ID request monitoring (706).

Figure 8:
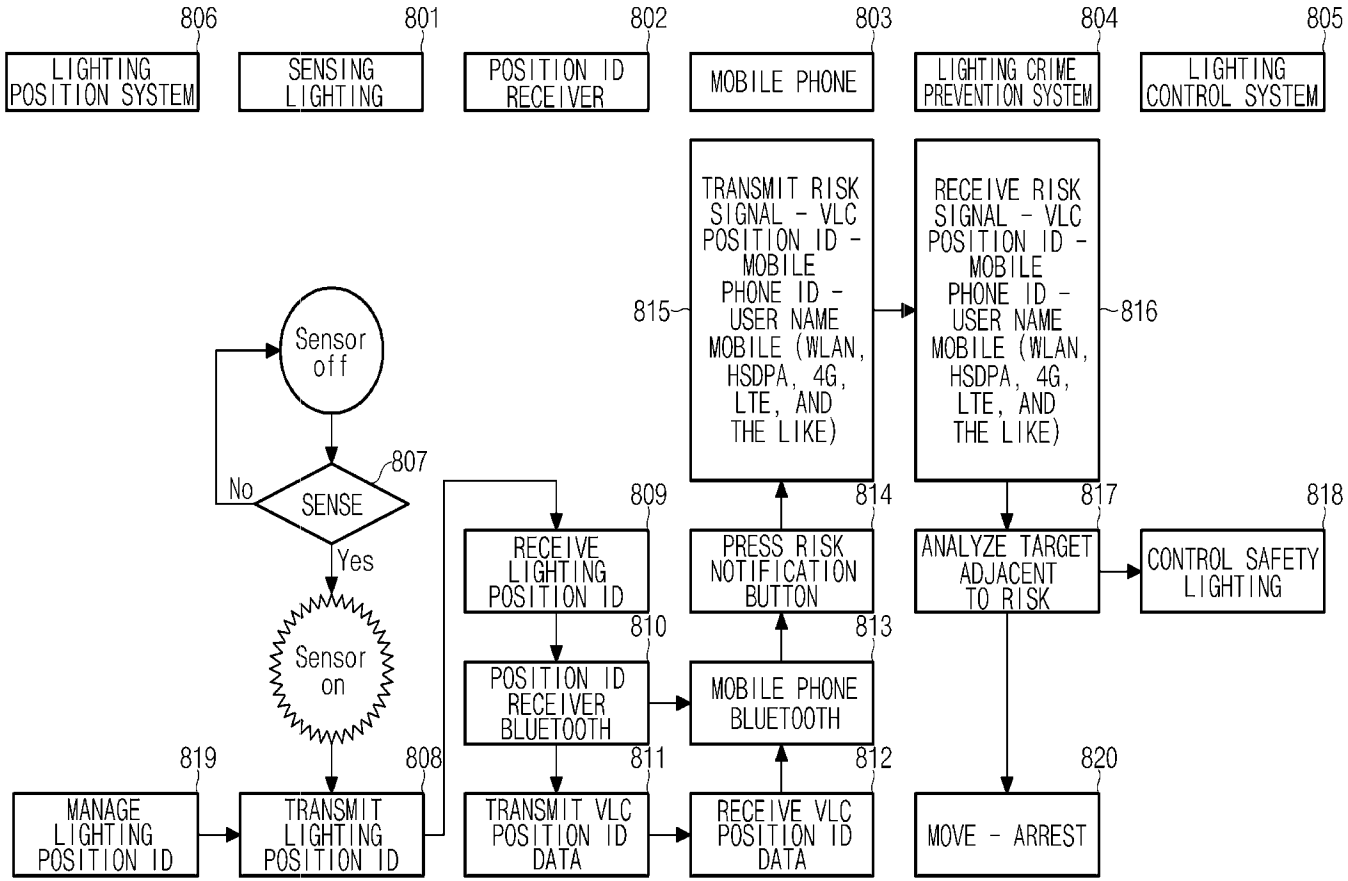
FIG. 8 illustrates an exemplary embodiment of a model using a safety communication system according to an exemplary embodiment of the present invention.

FIG. 8 illustrates an exemplary embodiment of a model using a safety communication system according to an exemplary embodiment of the present invention.

Referring to FIG. 8, a detailed configuration of a model using the safety communication system includes a sensing lighting 801, a position ID receiver 802, a mobile phone 803, a lighting crime prevention system 804, a lighting control system 805, and a lighting position system 806.

Herein, the lighting crime prevention system 804, the lighting control system 805, and the lighting position system 806 may correspond to the lighting crime prevention system 100, the lighting control system 101, and the lighting position system 102 described with reference to FIGS. 1 to 7, respectively.

The sensing lighting 801, the position ID receiver 802, and the mobile phone 803 are described as examples among devices and all of the device types mentioned in FIG. 1 may be included. That is, the detailed configuration may include all devices capable of collecting information, which include the speaker, the camera, the terminal, the LED lighting, and the VLC transmitter/receiver in addition to the sensing lighting 801, the position ID receiver 802, and the mobile phone 803. Moreover, the position ID receiver 802 and the mobile phone 803 may be provided as one device, but herein, will be described as individual devices.

The sensing lighting 801 which is turned off is provided in all areas where risk occurrence is anticipated.

Next, the sensing lighting 801 senses the risk situation (807). When there is no risk situation, the sensing lighting 801 continuously maintains the turn-off state.

Subsequently, when the risk situation occurs and the sensing lighting 801 is thus turned on, the sensing lighting 801 transmits position ID data of the lighting to the position ID receiver 802 (808) and the position ID receiver 802 receives the position ID data of the lighting from the sensing lighting 801 (809). In addition, the position ID data may be converted into VLC position ID data.

Herein, the position ID receiver 802 is connected to the mobile phone 803 of the user in advance to perform intercommunication through pairing using Bluetooth (810 and 813).

Next, the position ID receiver 802 transmits the VLC position ID data to the mobile phone 803 by using the Bluetooth (811). Subsequently, the mobile phone 803 receives the VLC position ID data (812).

Next, when the user operates a risk notification button by using the mobile phone 803 (814), the mobile phone 803 transmits to the lighting crime prevention system 804, risk situation data including the VLC position ID data, a mobile phone ID, a user name, and the like together with a risk signal (815). Herein, the mobile phone 803 may transfer information to the lighting crime prevention system 804 by using various wired/wireless communication methods including WLAN, HSDPA, 4G, LTE, LTE, WIFI, RFID, Zigbee, and the like.

Next, the lighting crime prevention system 804 receives data transmitted from the mobile phone 803 together with risk signal (816) and analyzes the risk situation as described in the description method disclosed in FIGS. 3 to 5 (817). That is, the lighting crime prevention system 804 analyzes a risk target based on the received data and updates information on a device installed around the risk target to request the lighting control system 805 to perform the safety lighting control.

Next, the analyzed risk situation data is transmitted to the lighting control system 805 to perform the safety lighting control like the description method disclosed in FIG. 6 (818). In other words, the lighting control system 805 performs the safety lighting control to respond to an urgent risk situation and controls the lighting in a neighboring area to notify the risk situation to a plurality of persons.

Subsequently, the lighting position system 806 may determine a risk area where the sensing lighting 801 operates by continuously updating and managing the lighting position ID of the sensing lighting 801 (819).

Thereafter, the lighting crime prevention system 805 may notify the risk situation to the security control center, the police station, and the public office in order to notify the risk situation including the movement route tracking information and a security control center officer or a policeman moves to a risk occurrence area determined by the lighting position system 806 to arrest the criminal or resolve the risk situation (820).

Figure 9:
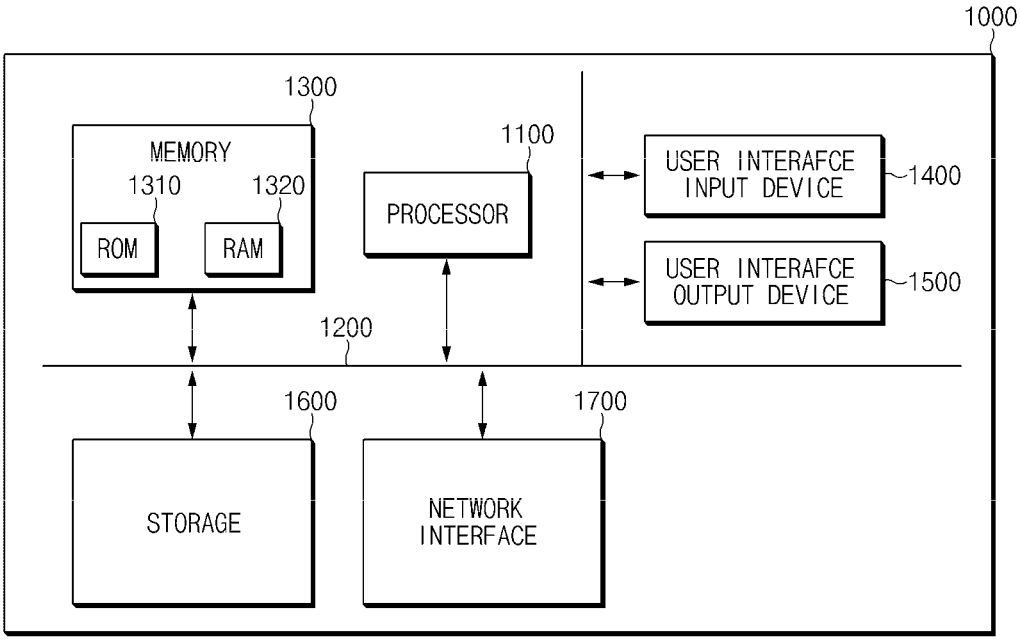
FIG. 9 illustrates a block diagram illustrating a computing system that executes a safety communication system according to an exemplary embodiment of the present invention.

FIG. 9 illustrates a block diagram illustrating a computing system that executes a safety communication system according to an exemplary embodiment of the present invention.

Referring to FIG. 9, the computing system 1000 may include at least one processor 1100, a memory 1300, a user interface input device 1400, a user interface output device 1500, a storage 1600, and a network interface 1700 connected through a bus 1200.

The processor 1100 may be a semiconductor device that processes commands stored in a central processing unit (CPU) or the memory 1300 and/or the storage 1600. The memory 1300 and the storage 1600 may include various types of volatile or nonvolatile storage media. For example, the memory 1300 may include a read only memory (ROM) and a random access memory (RAM).

Accordingly, steps of the method or algorithm described in association with the exemplary embodiments disclosed in the specification may be directly implemented by a hardware module, a software module or a combination thereof executed by the processor 100. The software module may reside in storage media (that is, the memory 1300 and/or the storage 1600) such as a RAM, a flash memory, a ROM, an EPROM, an EEPROM, a register, a hard disk, an attachable disk, and a CD-ROM. An exemplary storage medium may be coupled to the processor 1100, and the processor 1100 may read information from the storage medium and write information in the storage medium. As another method, the storage medium may be integrated with the processor 1100. The processor and the storage medium may reside in an application specific integrated circuit (ASIC). The ASIC may reside in a user terminal. As another method, the processor and the storage medium may reside in the user terminal as individual components.

As described above, although the present invention has been described by limited constitutions and drawings, the technical spirit of the present invention is not limited thereto and various modifications and modified examples can be made within the technical spirit and the equivalent range of the appended claims to be described below by those skilled in the art.

What is claimed is:

1. A safety communication system, comprising:

a device configured to sense a risk situation;

a lighting crime prevention system configures to analyze risk situation data received from the device and including a position ID to generate situation data; and a lighting control system configured to control an operation of a lighting depending on the situation data, wherein the lighting crime prevention system includes:

a risk situation detecting unit configured to extract the risk situation data received from the device and the position ID of the lighting, track a route, and notify the risk situation data and route tracking information to one or more of a police station, a public office, a security center, a control center, and the lighting control system;

a device detecting unit configured to update the information on the device; and a risk situation data analyzing unit configured to analyze and store data based on information collected from the device, generate a situation data schema, and track route data.

2. The safety communication system of claim 1, further comprising:

a lighting position system managing position ID information of the device.

3. The safety communication system of claim 2, wherein the lighting position system includes a lighting position unit configured to map the safety lighting network of the lighting control system and the lighting position.

4. The safety communication system of claim 3, wherein the lighting position unit includes:

a lighting position managing unit configured to manage the positional information of the lighting;

a lighting position data mapping unit configured to map the positional information of the lighting to the device and converting the positional information; and a lighting position data transmitting unit configured to transmit the positional information of the lighting to the device or the lighting control system.

5. The safety communication system of claim 1, wherein the risk situation detecting unit includes:

a VLC transmitting/receiving unit configured to transmit and receive VLC data;

a risk situation communication unit configured to transmit and receive data so as to communicate with the device;

a risk situation detecting unit configured to collect and detect information on the risk situation; and a risk situation monitoring unit configured to periodically monitor the situation data.

6. The safety communication system of claim 1, wherein the device detecting unit includes:

a device information receiving unit configured to receive information from the device;

a device information extracting unit configured to output the received data of the device;

a device interface unit configured to input, by a user, the information on the device;

a device monitoring unit configured to configure the device or monitor the collected information;

a device network managing unit configured to manage a device network by registering, changing, or deleting the device; and a device mapping unit configured to map the information on the device and positional information of the lighting.

7. The safety communication system of claim 1, wherein the risk situation data analyzing unit includes:

a situation data interanalyzing unit configured to analyze the situation data, and to collect and analyze device network information;

a route tracking unit configured to track a movement route based on the device network information;

a situation data schema processing unit configured to classify the analyzed situation data into a situation data schema;

a situation data generating unit configured to generate the situation data;

a situation data storing unit configured to store the situation data; and an external/internal data transmitting unit configured to transmit the situation data to the lighting control system.

8. A safety communication system, comprising:

a device configured to sense a risk situation;

a lighting crime prevention system configured to analyze risk situation data received from the device and including a position ID to generate situation data; and a lighting control system configured to control an operation of a lighting depending on the situation data, wherein the lighting control system includes a lighting control unit constructing a safety lighting network, and wherein the lighting control unit includes:

a lighting situation data processing unit configured to extract lighting situation data by receiving the situation data;

a lighting control data processing unit configured to control the lighting based on the lighting situation data;

a lighting data transmitting unit configured to transmit data for controlling the lighting;

a safety lighting group managing unit configured to perform group management of the lighting for each area through the safety lighting network;

a safety lighting network managing unit configured to perform design and manage the safety lighting network; and a safety lighting interface unit configured to perform interconvert data configuring the safety lighting network.

9. A safety communication method, comprising:

sensing, by a device, a risk situation and generating risk situation data;

transmitting, by the device, the risk situation data including a position ID to a lighting crime prevention system;

analyzing, by the lighting crime prevention system, the risk situation data and generating situation data;

transmitting the situation data to a lighting control system; and controlling, by the lighting control system, an operation of a lighting depending on the situation data, wherein the transmitting, by the device, of the risk situation data to the lighting crime prevention system includes:

sensing, by the device, the risk situation;

transmitting position ID data of the device to a position ID receiver;

converting the position ID data into VLC position ID data;

transmitting, by the position ID receiver, the VLC position ID data to a mobile phone; and transmitting the risk situation data by using the mobile phone.

10. The safety communication method of claim 9, wherein the risk situation data includes a VLC position, a mobile ID, and a user name.

11. The safety communication method of claim 9, wherein the position ID receivers are paired by using the mobile phone and the Bluetooth.

12. The safety communication method of claim 9, wherein in the transmitting of the risk situation data to the lighting crime prevention system, a communication interface using the mobile phone is used.

13. The safety communication method of claim 12, wherein the communication interface includes one or more of WLANRS485, WLAN, HSDPA, 4G, LTE, WIFI, RFID, Zigbee, DALI, DMX, and VLC.

14. The safety communication method of claim 9, further comprising:

managing, by a lighting position system, position ID information of the device.

15. The safety communication method of claim 9, wherein the device includes devices capable of collecting information, including one or more of a CCTV, a speaker, a camera, a terminal, an LED lighting, and a VLC transmitter/receiver.

* * * * *